US009689628B2

(12) United States Patent
Uno et al.

(10) Patent No.: US 9,689,628 B2
(45) Date of Patent: Jun. 27, 2017

(54) OIL COOLER WITH INNER FIN

(75) Inventors: Takahiro Uno, Kariya (JP); Hiroyuki Osakabe, Nagoya (JP); Daisuke Takahashi, Kariya (JP)

(73) Assignee: DENSO CORPORATION, Kariya, Aichi-pref (JP)

( * ) Notice: Subject to any disclaimer, the term of this patent is extended or adjusted under 35 U.S.C. 154(b) by 0 days.

(21) Appl. No.: 13/135,478

(22) Filed: Jul. 6, 2011

(65) Prior Publication Data

US 2012/0031593 A1 Feb. 9, 2012

(30) Foreign Application Priority Data

Jul. 9, 2010 (JP) ..... 2010-156700

(51) Int. Cl.
*F28F 13/12* (2006.01)
*F28F 9/02* (2006.01)
(Continued)

(52) U.S. Cl.
CPC ..... *F28F 9/0234* (2013.01); *F28D 9/0043* (2013.01); *F28F 3/027* (2013.01); *F28D 2021/0089* (2013.01)

(58) Field of Classification Search
CPC .. F28F 9/0234; F28F 13/12; F28F 3/02; F28F 3/027; F28F 1/40; F28F 2215/08; F28D 9/0043; F28D 2021/0089
(Continued)

(56) References Cited

U.S. PATENT DOCUMENTS 3,521,707 A * 7/1970 Brown ..... 165/152
5,072,780 A * 12/1991 Yabe ..... 165/96
(Continued)

FOREIGN PATENT DOCUMENTS

JP 62-005098 1/1987
JP 03-045891 2/1991
(Continued)

OTHER PUBLICATIONS

Office action dated Aug. 6, 2012 in corresponding Japanese Application No. 2010-156700.
(Continued)

*Primary Examiner* — Ryan J Walters
*Assistant Examiner* — Jon T Schermerhorn
(74) *Attorney, Agent, or Firm* — Harness, Dickey & Pierce, P.L.C.

(57) ABSTRACT

An inner fin is an offset fin having a wavy cross-section that is perpendicular to an oil flowing direction, and has a louver that is partially cut and bent in a direction parallel with the oil flowing direction. The wavy cross-section is defined by alternately placing first-side convex parts and second-side convex parts. A fin height fh is defined by a distance from the first-side convex part to the second-side convex part in the cross-section. An area surrounded by the inner fin, a tube, and the first-side or second-side convex parts located adjacent with each other on the same side in the cross-section is converted into a corresponding circle having a diameter de. When a relationship of $X=de/fh^{0.3}$ is defined, the diameter of the corresponding circle and the fin height respectively have dimensions that satisfy a relationship of $0.5 \leq X \leq 1.0$.

14 Claims, 8 Drawing Sheets

(51) Int. Cl.

| | |
|---|---|
| ***F28D 9/00*** | (2006.01) |
| ***F28F 3/02*** | (2006.01) |
| *F28D 21/00* | (2006.01) |

(58) Field of Classification Search
USPC ..... 165/177, 916, 109.1, 181, 182
See application file for complete search history.

(56) References Cited

U.S. PATENT DOCUMENTS

| | | | | |
|---|---|---|---|---|
| 5,078,207 | A | 1/1992 | Asano et al. | |
| 5,107,922 | A * | 4/1992 | So | 165/109.1 |
| 5,625,229 | A * | 4/1997 | Kojima et al. | 257/712 |
| 6,901,995 | B2 * | 6/2005 | Yamaguchi et al. | 165/152 |
| 2002/0153131 | A1 * | 10/2002 | Sugawara et al. | 165/173 |
| 2005/0121179 | A1 * | 6/2005 | Shibagaki et al. | 165/153 |
| 2005/0247444 | A1 | 11/2005 | Ohata et al. | |
| 2006/0278378 | A1 * | 12/2006 | Okura et al. | 165/140 |
| 2007/0012430 | A1 * | 1/2007 | Duke et al. | 165/109.1 |
| 2008/0011464 | A1 | 1/2008 | Oofune et al. | |
| 2009/0065183 | A1 | 3/2009 | Uneno | |

FOREIGN PATENT DOCUMENTS

| | | |
|---|---|---|
| JP | 10-148493 | 6/1998 |
| JP | 2009-063228 | 3/2009 |

OTHER PUBLICATIONS

Office Action dated Jul. 24, 2012 in corresponding Chinese Application No. 201110187973.7 with English translation.
Office action issued Feb. 18, 2014 in corresponding JP Application No. 2010-156700 (with English translation).

* cited by examiner

OIL COOLER WITH INNER FIN

CROSS REFERENCE TO RELATED APPLICATION

This application is based on Japanese Patent Application No. 2010-156700 filed on Jul. 9, 2010, the disclosure of which is incorporated herein by reference in its entirety.

BACKGROUND ART

The present invention relates to an oil cooler, for example, which cools engine oil or working oil of automatic transmission (ATF) for a vehicle.

Conventionally, the oil cooler arranged inside of a tank of a radiator has plural tubes stacked with each other, and oil flows through the tubes. Heat exchange is performed between oil passing through the tube and cooling water passing outside of the tube, so that oil is cooled. Moreover, an inner fin is arranged inside the tube, and promotes the heat exchange between oil and cooling water.

Such oil cooler secures suitable radiation performance by increasing the number of the tubes, as a heat emitting amount is required to be increased. Here, a size of the radiator tank is inevitably decided by a size of the oil cooler. In order to make the radiator tank to be thin and light, it is necessary to reduce the stacking number of the tubes by improving radiation performance per tube in the oil cooler.

By the way, as a kind of the inner fin, an offset fin is known (for example, refer to JP-B2-4240136) other than straight fin and wavy fin. The offset fin is usually used for a different use from the oil cooler, for example, for a heat exchanger which cools exhaust gas in an exhaust gas recirculation device (hereinafter referred as EGR cooler), or an intercooler.

However, physical properties of fluid to be cooled by the oil cooler are different from those to be cooled by the EGR cooler or the intercooler, as to be mentioned below. Therefore, dimensions of fin pitch fp, fin height fh, and segment length L of the conventional offset fin for the EGR cooler or intercooler cannot be directly applied to the oil cooler.

That is, in the oil cooler, a flow velocity of oil in the tube is as low as about 0.2-0.4 m/s. It is used in a range where the Reynolds number is as small as about 20-40 (laminar-flow region) when a diameter of a corresponding circle is defined as a representative length. Dynamic coefficient of viscosity has high temperature dependency. Further, since the Prandtl number of oil is as large as 100 or more, heat transfer phenomenon is different from the EGR cooler or intercooler which cools air.

Moreover, due to the above-mentioned physical properties of oil, a thickness of thermal boundary layer which influences heat transfer performance becomes very thin in the oil cooler. By reducing (decreasing) a fin pitch fp up to reaction limit of effect that tears the thermal boundary layer, heat transfer area is increased so as to promote the heat transfer.

If the conventional offset fin for the EGR cooler or intercooler is simply applied to the offset fin for the oil cooler, heat emitting properties of the oil cooler may be lowered.

DISCLOSURE OF THE INVENTION

In view of the foregoing and other problems, it is an object of the present invention to raise performance by calculating fin conditions for obtaining high performance when an offset fin is used as an inner fin while a stacking number of tubes is reduced in an oil cooler.

In order to achieve the above object, an example of oil cooler of the present invention includes plural tubes stacked with each other, and plural inner fins respectively arranged in the tubes. Oil passes inside of the tube, and cooling medium passes outside of the tube. The inner fin promotes heat exchange between oil and cooling medium. The inner fin is an offset fin having a wavy cross-section that is perpendicular to an oil flowing direction. The wavy cross-section is defined by alternately placing first-side convex parts and second-side convex parts. The inner fin has a louver that is partially cut and bent in a direction parallel with the oil flowing direction. A fin height fh is defined by a distance from the first-side convex part to the second-side convex part in the cross-section. An area surrounded by the inner fin, the tube, and the first-side or second-side convex parts located adjacent with each other on the same side in the cross-section is converted into a corresponding circle having a diameter de. When a relationship of $X=de/fh^{0.3}$ is defined, the diameter of the corresponding circle and the fin height respectively have dimensions that satisfy a relationship of $0.5 \leq X \leq 1.0$.

Accordingly, even if the fin height fh is set arbitrarily, a real-mounted performance Qvo can be improved in the range of $0.5 \leq X \leq 1.0$, so that the performance can be raised while the stacking number of the tubes is reduced in the oil cooler.

Further, for example, the diameter of the corresponding circle and the fin height respectively have dimensions that satisfy a relationship of $0.6 \leq X \leq 0.9$.

In this case, even if the fin height fh is set arbitrarily, the real-mounted performance Qvo can be more improved in the range of $0.6 \leq X \leq 0.9$, so that the performance can be reliably raised while the stacking number of the tubes is reliably reduced in the oil cooler.

Further, an example of oil cooler of the present invention includes plural tubes stacked with each other, and plural inner fins respectively arranged in the tubes. Oil passes inside of the tube, and cooling medium passes outside of the tube. The inner fin promotes heat exchange between oil and cooling medium. The inner fin is an offset fin having a wavy cross-section that is perpendicular to an oil flowing direction. The wavy cross-section is defined by alternately placing first-side convex parts and second-side convex parts. The inner fin has a louver that is partially cut and bent in a direction parallel with the oil flowing direction. A fin pitch fp is defined by a distance between center points of the first-side or second-side convex parts located adjacent with each other on the same side in the cross-section. A fin height fh is defined by a distance from the first-side convex part to the second-side convex part in the cross-section. The fin pitch and the fin height respectively have dimensions that satisfy a relationship of $0.3 < fp/fh < 0.8$.

Accordingly, the real-mounted performance Qvo, that is an index in consideration of both of a radiation performance Qo and a pressure loss $\Delta Po$, can be raised, so that the same performance can be secured as a conventional oil cooler even when the stacking number of tubes is reduced. Therefore, the performance is improved while the stacking number of tubes is reduced in the oil cooler.

Further, for example, the fin pitch and the fin height respectively have dimensions that satisfy a relationship of $0.4 < fp/fh < 0.75$.

Accordingly, the real-mounted performance Qvo can be reliably raised, so that the performance is reliably improved while the stacking number of tubes is reliably reduced in the oil cooler.

Further, for example, the fin pitch and the fin height respectively have dimensions that satisfy a relationship of $0.5<fp/fh<0.7$.

Accordingly, the real-mounted performance Qvo can be more reliably raised, so that the performance is more reliably improved while the stacking number of tubes is more reliably reduced in the oil cooler.

Further, for example, in the oil cooler, the inner fin is configured to have a wall part located between the first-side convex part and the second-side convex part in the cross-section. When the wall part is defined to have an inclination angle θ (unit: °) with respect to a direction of the fin height in the cross-section, the inclination angle has a value that satisfies $0\leq\theta\leq20$.

Accordingly, flowing velocity distribution of oil can be equalized in the tube, so that heat transfer between the inner fin and oil can be efficiently performed. Thus, the radiation performance can be improved.

PREFERRED EMBODIMENT

Figure 1:
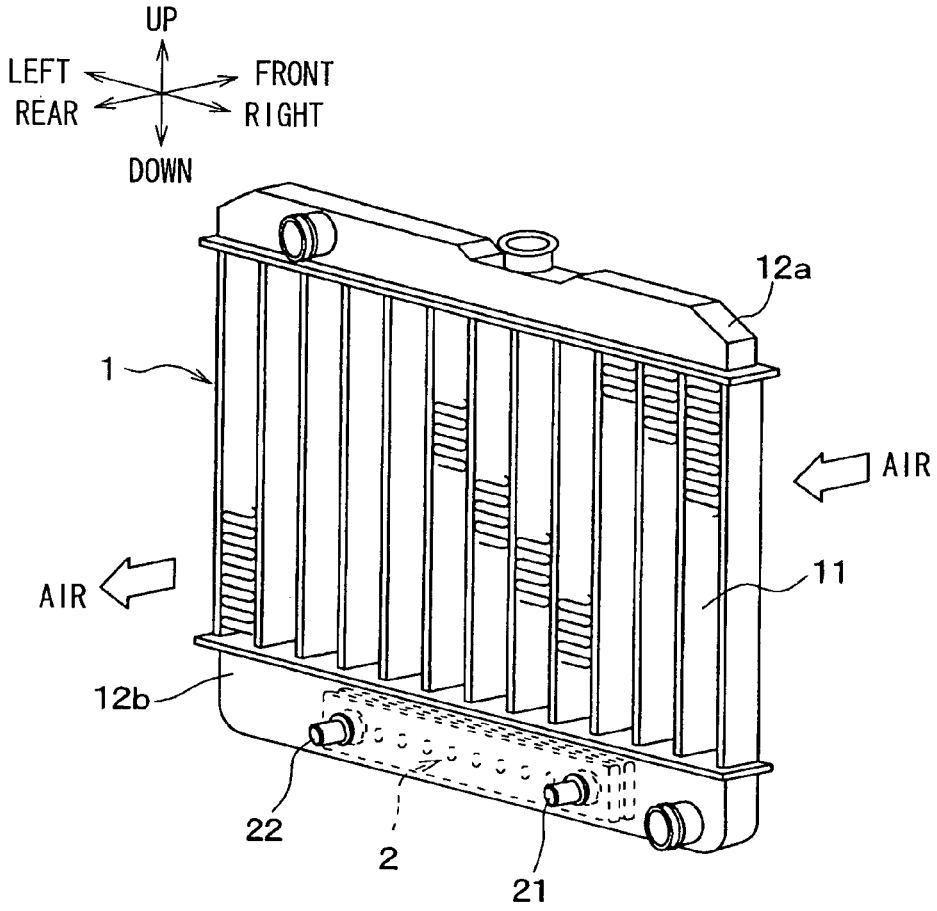
FIG. 1 is a perspective view illustrating a radiator including an oil cooler according to an embodiment.

FIG. 1 is a perspective view illustrating a radiator 1 including an oil cooler 2 according to an embodiment. As shown in FIG. 1, the radiator 1 of the embodiment has plural radiator tubes 11 and first and second radiator tanks 12*a*, 12*b*. Engine cooling water flows through the tube 11 made of aluminum. The tanks 12*a*, 12*b* made of aluminum are arranged longitudinal ends of the tube 11, respectively, and make the tubes 11 to communicate with each other.

The first radiator tank 12*a* is connected to an upper end of the tubes 11, and distributes engine cooling water into the tubes 11. The second radiator tank 12*b* is connected to a lower end of the tubes 11, and gathers engine cooling water from the tubes 11.

The oil cooler 2 is arranged in the second radiator tank 12*b*, in a state that a longitudinal direction of the oil cooler 2 is coincided with that of the second radiator tank 12*b*. A cylindrical inlet part 21 and a cylindrical outlet part 22 of the oil cooler 2 are projected from a side wall of the second radiator tank 12*b*. In addition, the oil cooler 2 is fixed to an inner wall of the second radiator tank 12*b* with a screw etc.

Figure 2:
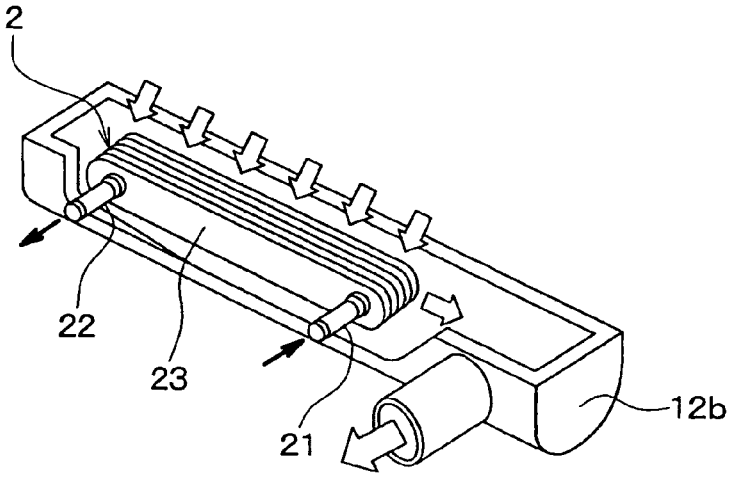
FIG. 2 is an exploded perspective view illustrating a second radiator tank of FIG. 1.
Figure 3:
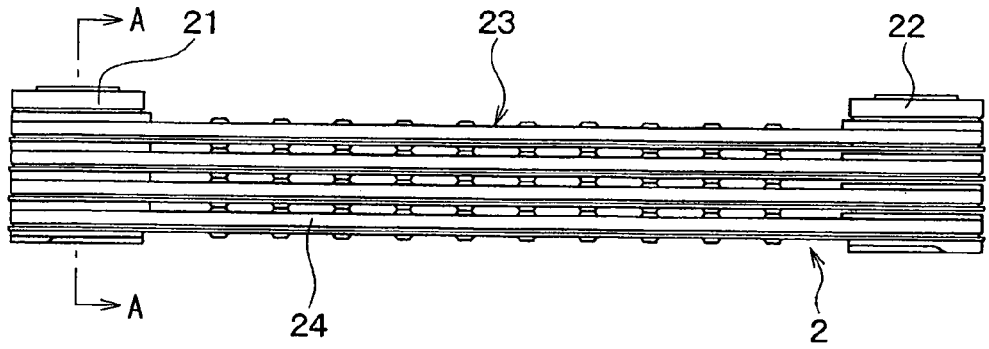
FIG. 3 is a front view illustrating a core part of the oil cooler of the embodiment.
Figure 4:
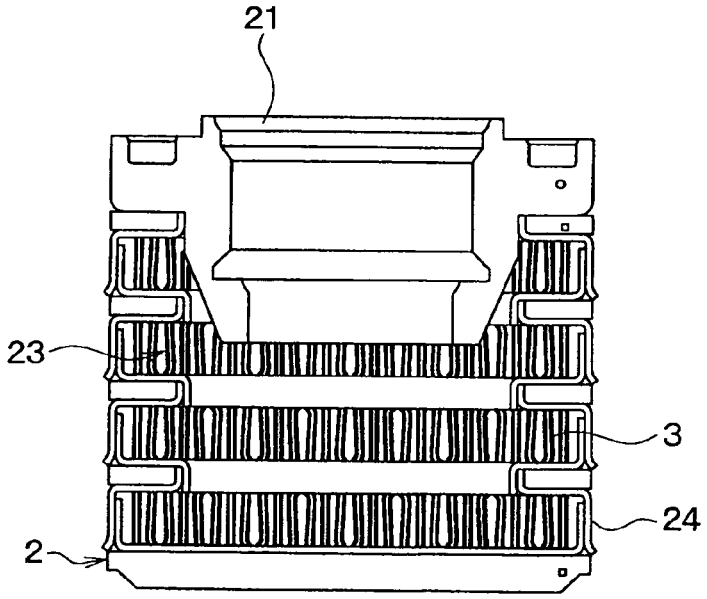
FIG. 4 is a cross-sectional view taken along line A-A of FIG. 3.

Next, a structure of the oil cooler 2 will be described. FIG. 2 is an exploded perspective view illustrating the second radiator tank 12*b* of FIG. 1. FIG. 3 is a front view illustrating a core part 23 of the oil cooler 2 of the embodiment. FIG. 4 is a cross-sectional view taken along line A-A of FIG. 3. In FIG. 2, a white blank arrow shows a flow of engine cooling water, and a continuous-line arrow shows a flow of oil.

As shown in FIG. 2-FIG. 4, the oil cooler 2 has the inlet part 21, the outlet part 22, and the core part 23. The inlet part 21 is provided for flowing oil into the core part 23, and the outlet part 22 is provided for flowing oil out of the core part 23. Moreover, the core part 23 is constituted by stacking plural flat tubes 24 through which oil passes. Heat exchange is performed between oil and engine cooling water, so as to cool oil. The engine cooling water may be equivalent to cooling medium of the present invention.

Oil may be engine oil which lubricates a sliding part in an engine, or automatic transmission fluid (ATF).

An inner fin 3 is arranged in each of the tubes 24, and promotes the heat exchange between oil and engine cooling water. The inner fin 3 is fixed to an inner wall face of the tube 24. Hereafter, details of the inner fin 3 are explained.

Figure 5:
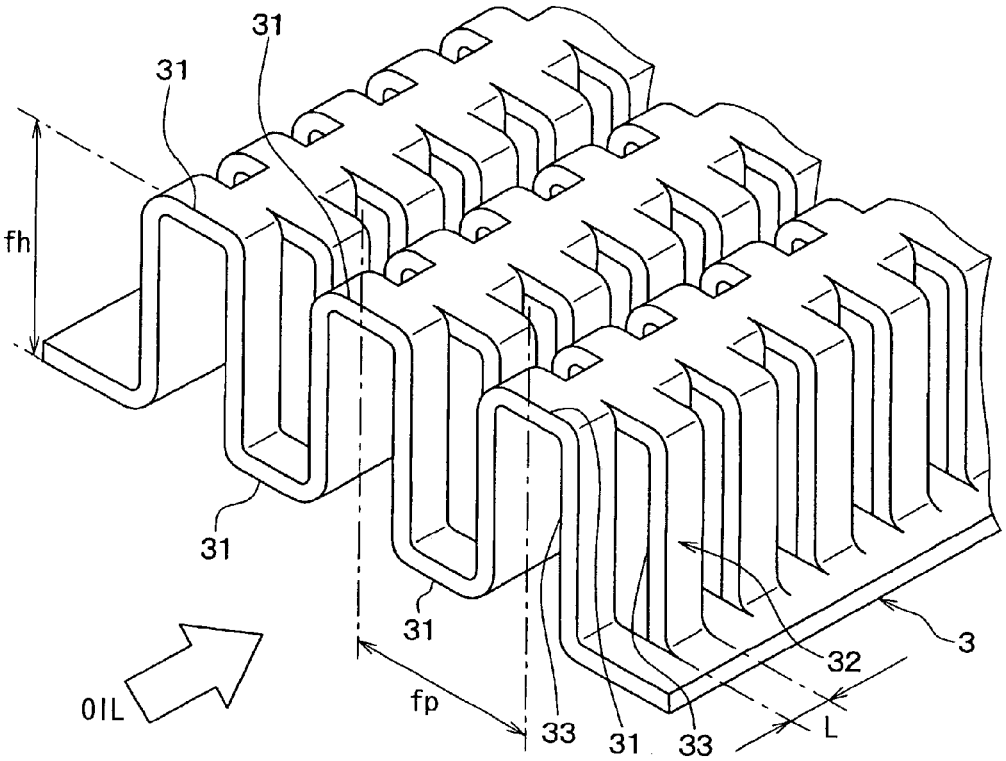
FIG. 5 is a perspective view illustrating an inner fin of the embodiment.
Figure 6:
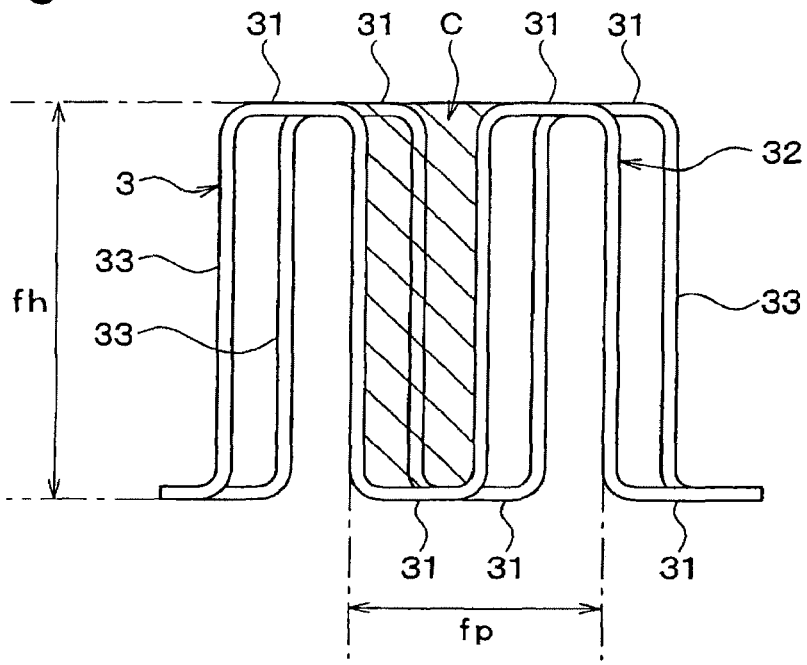
FIG. 6 is a partial enlarged view illustrating the inner fin when seen from an oil flowing direction in the embodiment.

FIG. 5 is a perspective view illustrating the inner fin 3 of the embodiment. FIG. 6 is a partial enlarged view of the inner fin 3 when seen from an oil flowing direction in the embodiment.

As shown in FIGS. 5, 6, the inner fin 3 is an offset fin having a wavy cross-section that is approximately perpendicular to the oil flowing direction. That is, the cross-section seen from the oil flowing direction has a corrugated shape in which convex parts 31 are located alternately on a first side and a second side. The inner fin 3 has louvers 32 partially cut and bent in the oil flowing direction. When seen from the oil flowing direction, a wavy part defined by the louver 32 is offset relative to another adjacent wavy part in the oil flowing direction. The convex part 31 of the offset fin 3 is contact with the inner wall face of the tube 24.

Inside of the tube 24 is divided (partitioned) into plural passages by the offset fin 3. Further, the plural passages are partially offset with each other in the oil flowing direction. That is, as shown in FIG. 5, a wall part 33 which divides the inside of the tube 24 into the plural passages is alternately arranged along the oil flowing direction. Moreover, when the offset fin 3 is seen in the oil flowing direction, the first-side or second-side convex parts 31 located adjacent with each other on the same side in the oil flowing direction are located offset from each other.

Figure 7:
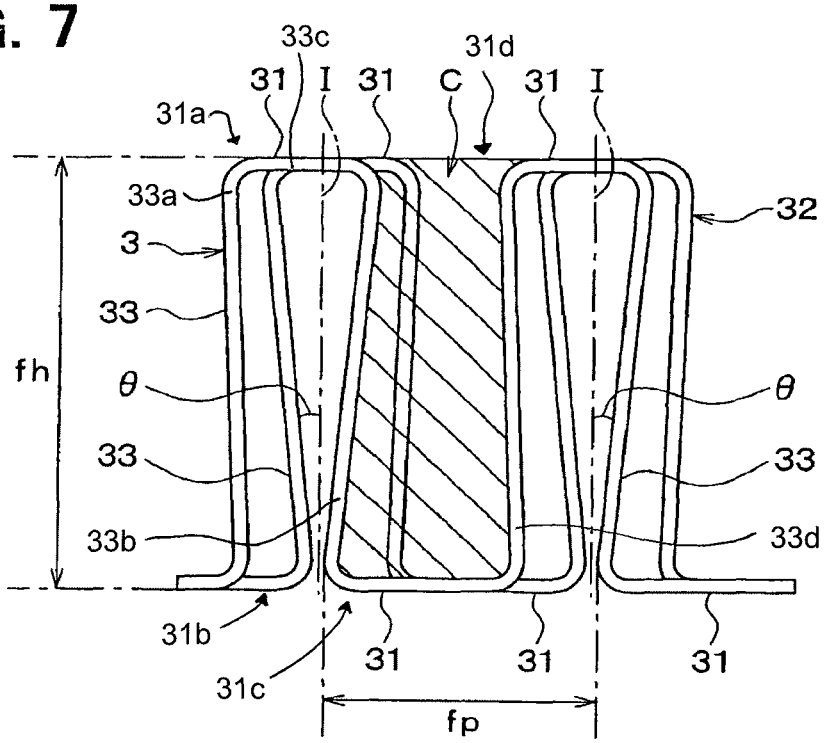
FIG. 7 is a partial enlarged view illustrating a modification of the inner fin when seen from the oil flowing direction in the embodiment.

FIG. 7 is a partial enlarged view of the inner fin 3 seen from the oil flowing direction according to a modification of the embodiment.

In the embodiment, as shown in FIGS. 6, 7, the offset fin 3 has a rectangular cross-section that is approximately perpendicular to the oil flowing direction. A hatched area C surrounded by the offset fin 3, the tube 24, and the first-side or second-side convex parts 31 located adjacent with each other on the same side has an approximately rectangular shape.

Here, "approximately rectangular shape" refers to not only the offset fin 3 of FIG. 6 but also the offset fin 4 of FIG. 7. In FIG. 6, the wall part 33 extends approximately parallel with a fin height direction, i.e., the stacking direction of the tubes 24, in the cross-section approximately perpendicular to the oil flowing direction. In FIG. 7, the wall part 33 is slightly inclined relative to the fin height direction in the cross-section approximately perpendicular to the oil flowing direction.

Specifically, in the cross-section of the offset fin 3 that is approximately perpendicular to the oil flowing direction, the wall part 33 has an inclination angle θ relative to an imaginary line l that is parallel to the fin height direction, i.e., the stacking direction of the tubes 24, and the inclination angle θ satisfies a relationship of $0 \leq \theta \leq 20$ (unit: °). As illustrated in FIG. 7, the first-side convex part has a closed side 31*a* defined by a first wall 33*a* and a second wall 33*b*. Upper wall 33*c* closes closed side 31*a*. The opposite ends of first and second walls 33*a* and 33*b* define an open side 31*b* of the first-side convex part. The second-side convex part has a closed side 31*c* defined by second wall 33*b* and a third wall 33*d*. Lower wall 33*e* closes the closed side 31*c*. The opposite ends of second and third walls 33*b* and 33*d* define an open side 31*d* of the second-side convex part.

In the offset fin 3 having such construction, a performance of the oil cooler 2 is determined by a fin pitch fp (unit: mm) and a fin height fh (unit: mm). As shown in FIGS. 5-7, the fin pitch fp is a distance between center points of the first-side or second-side convex parts 31 located adjacent with each other on the same side. The fin height fh is a distance from the first side convex part to the second side convex part. In addition, the fin height fh is a distance in a direction perpendicular to the inner wall face of the tube 24 with which the offset fin 3 contacts, and is equivalent to an inner diameter of the tube 24 in the stacking direction of the tubes 24.

Then, inventors investigate optimal specification of the offset fin 3. In the embodiment, the oil coolers 2 are produced by variously changing the fin pitch fp and the fin height fh. While oil and engine cooling water are made to flow under a predetermined condition, pressure loss of oil flowing inside of the tube 24 and heat emitting property of the oil cooler are evaluated, and the optimal specification is determined based on results of the evaluation.

Figure 8:
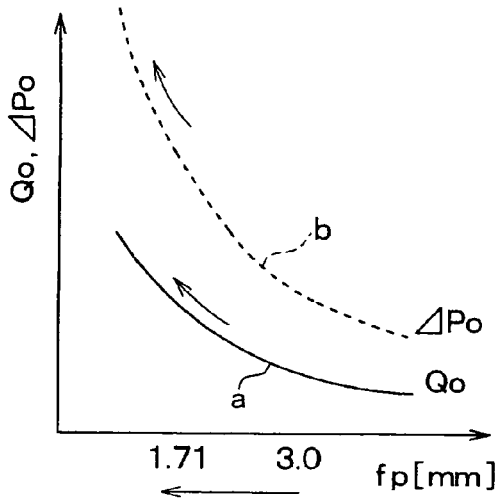
FIG. 8 is a characteristic view illustrating a relationship between a fin pitch fp and a radiation performance Qo and a relationship between a fin pitch fp and a pressure loss ΔPo, in a case where a fin height fh of the offset fin is set as constant.
Figure 9:
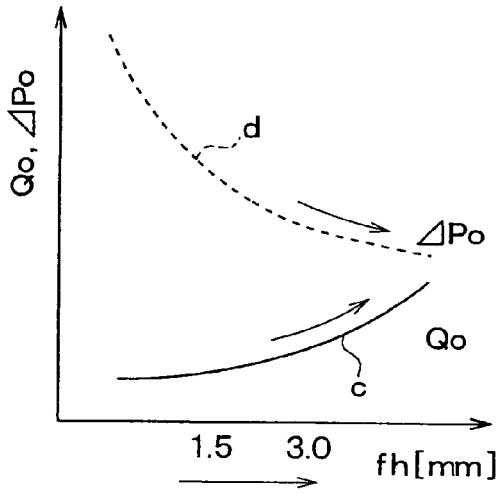
FIG. 9 is a characteristic view illustrating a relationship between a fin height fh and a radiation performance Qo and a relationship between a fin height fh and a pressure loss ΔPo, in a case where a fin pitch fp of the offset fin is set as constant.

FIG. 8 is a characteristic view showing a relationship between the fin pitch fp and a radiation performance Qo and a relationship between the fin pitch fp and a pressure loss ΔPo, in a case where the fin height fh of the offset fin 3 is set as constant. FIG. 9 is a characteristic view showing a relationship between the fin height fh and a radiation performance Qo and a relationship between the fin height fh and a pressure loss ΔPo, in a case where the fin pitch fp of the offset fin 3 is set as constant.

Usually, if the fin pitch fp of the offset fin 3 is made smaller, as shown in a continuous-line a in FIG. 8, the radiation performance Qo is increased because a heat transfer rate and a heat transfer area are increased. However, as shown in a broken line b in FIG. 8, the pressure loss ΔPo is also increased rapidly. In contrast, if the fin height fh is made higher, as shown in a continuous-line c in FIG. 9, the radiation performance Qo is increased because a heat transfer area is increased. However, as shown in a broken line d in FIG. 9, the pressure loss ΔPo is decreased because the flow velocity of oil is lowered in the tube 24.

For this reason, as a shape of the offset fin 3, the radiation performance Qo is increased by making the fin pitch fp minute as much as possible. Further, it is desirable to make the fin height fh higher so as to minimize the pressure loss ΔPo which is increased by making the fin pitch fp minute. That is, it is desirable to enlarge the fin height fh with respect to the fin pitch fp. On the other hand, the size of the oil cooler 2 becomes large if the fin height fh is made higher. Optimal specification of the fin height fh is investigated below.

Figure 10:
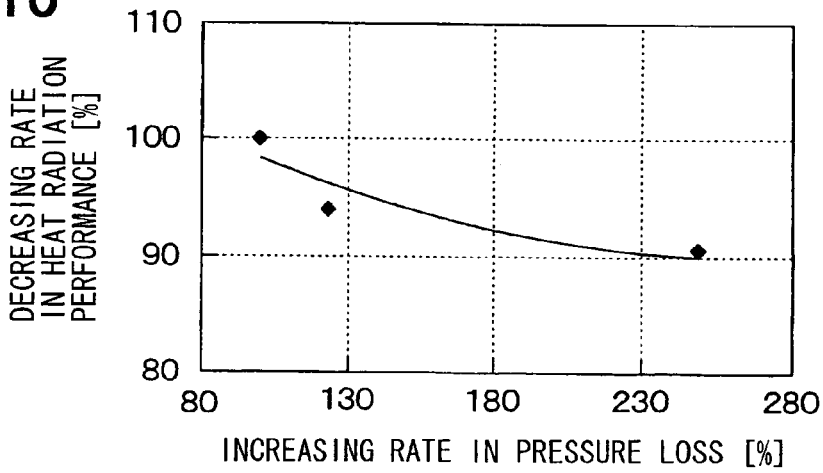
FIG. 10 is a characteristic view illustrating results of experiments to investigate influence between an increasing rate in a pressure loss and a decreasing rate in a radiation performance when the oil cooler is mounted on a real vehicle.

Here, the oil cooler 2 is mounted on a real vehicle, and influence between an increasing rate in the pressure loss and a decreasing rate in the radiation performance is investigated through experiments. The results of the experiments are shown in FIG. 10. As shown in FIG. 10, a relationship of $Qvo=1/\Delta Po^{0.1}$ can be found between the radiation performance at the time when the oil cooler is mounted on the real vehicle (hereinafter referred as the real-mounted performance Qvo) and the pressure loss ΔPo.

Figure 11:
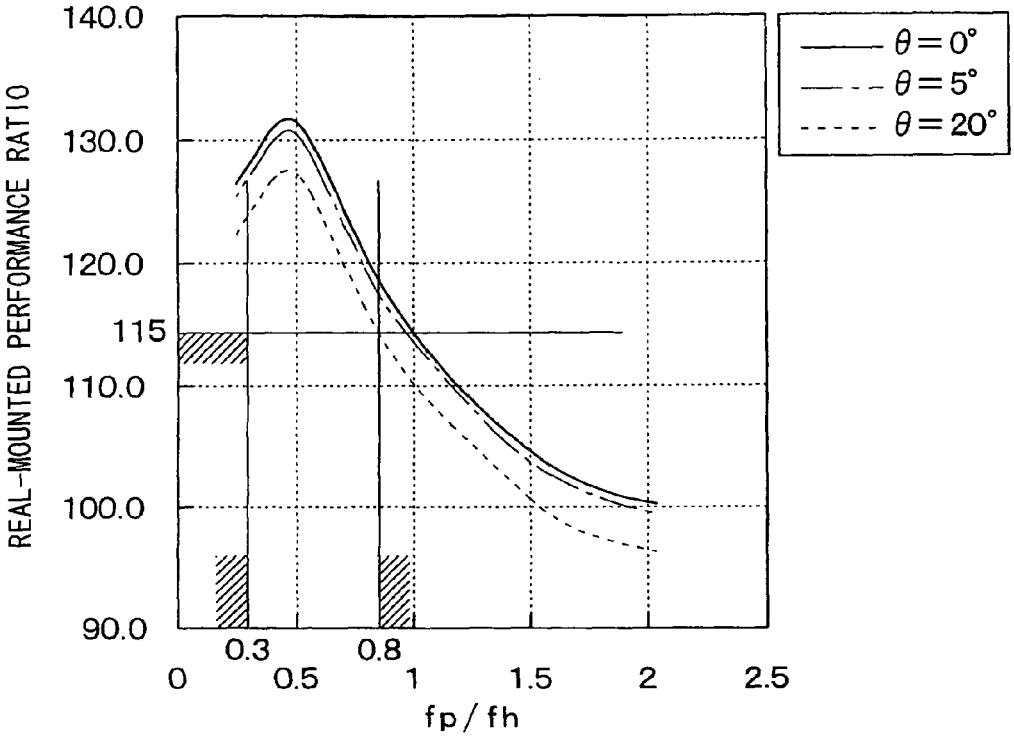
FIG. 11 is a characteristics view illustrating a relationship between an aspect ratio fp/fh of the offset fin and a real-mounted performance Qvo.

FIG. 11 is a characteristics view showing a relationship between an aspect ratio fp/fh and the real-mounted performance Qvo. The aspect ratio fp/fh is defined by a ratio of the fin pitch fp to the fin height fh in the offset fin 3. In addition, a real-mounted performance ratio indicated by a vertical axis of FIG. 11 is defined by comparing with the conventional offset fin whose aspect ratio fp/fh is 2.0. If the real-mounted performance ratio is made equal to or higher than 115%, the stacking number of the tubes 24 in the oil cooler 2 can be reduced by at least one-stack from the conventional oil cooler.

When the aspect ratio fp/fh of the offset fins 3 is set about 0.45 in curves of FIG. 11, the real-mounted performance ratio has the maximum value. That is, the real-mounted performance Qvo becomes the best at this time. Moreover, by making the aspect ratio fp/fh smaller than 0.8, the real-mounted performance ratio can be secured to be equal to or higher than 115%, in the offset fin 3 in which the wall part 33 has the inclination angle θ of 20°, so that the stacking number of the tubes 24 can be reduced by at least one-stack. In contrast, the aspect ratio fp/fh is set greater than 0.3 in consideration of the present working limit.

Therefore, the real-mounted performance Qvo, which is an index in consideration of both the radiation performance Qo and the pressure loss ΔPo, can be raised by setting the fin pitch fp and the fin height fh to satisfy a relationship of $0.3<fp/fh<0.8$. Moreover, within the range of $0.3<fp/fh<0.8$, the real-mounted performance ratio is secured to be equal to or higher than 115%, so that the stacking number of the tubes 24 can be reduced by at least one step compared with the conventional oil cooler. Furthermore, it is desirable to make the fin pitch fp and fin height fh to satisfy a relationship of $0.4<fp/fh<0.75$, and it is more desirable to satisfy a relationship of $0.5<fp/fh<0.7$.

Figure 12:
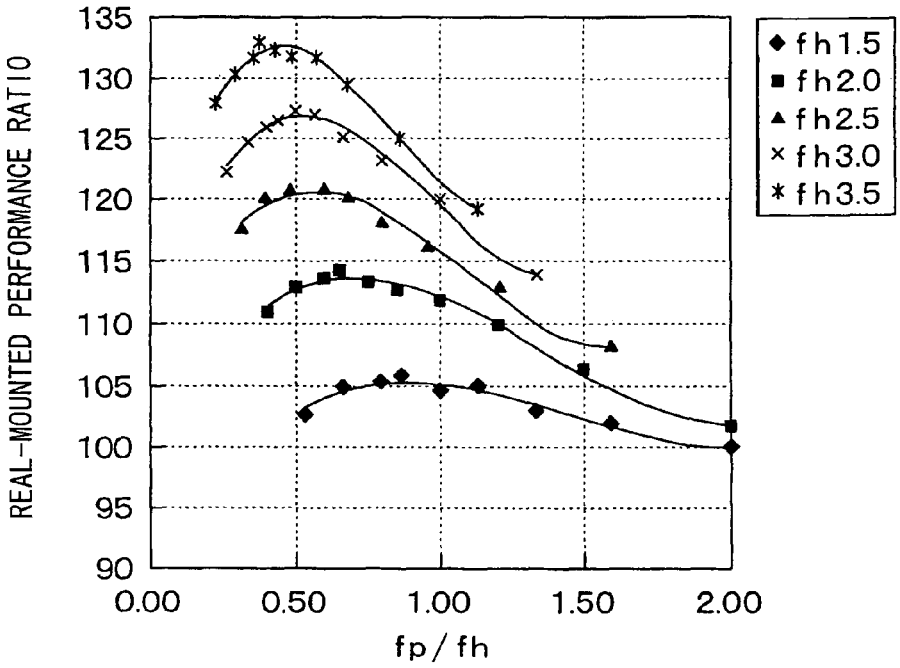
FIG. 12 is a characteristic view illustrating a relationship between the aspect ratio fp/fh and the real-mounted performance Qvo when the fin height fh of the offset fins is changed.

Here, FIG. 12 is a characteristic view showing a relationship between the aspect ratio fp/fh and the real-mounted performance Qvo when the fin height fh of the offset fins 3 is changed. As shown in FIG. 12, when the fin height fh is changed, the maximum value of the real-mounted performance Qvo is changed depending on the fin height fh.

For this reason, optimal specification of the offset fin 3 is investigated based on a relationship between a function X and the real-mounted performance Qvo below. The function X is defined by using the fin height fh and a diameter de of a corresponding circle of an oil passage divided by the offset fin 3.

Here, as shown in FIG. 6, the corresponding circle diameter de means a diameter (unit: mm) defined when the hatched area C is converted into the corresponding circle. The hatched area C is surrounded by the offset fin 3, the tube 24, and the first-side or second-side convex parts 31 located adjacent with each other on the same side, in the cross-section of the offset fin 3 approximately perpendicular to the oil flowing direction. The corresponding circle diameter de is expressed with the following formula.

$$de=4\times s/l$$

In addition, s is a cross-sectional area of the oil passage (equivalent to a cross-sectional area $\pi D2/4$ of a circle when the circle is defined to have a diameter of D). Further, l is a wet marginal length (equivalent to circumference length $\pi D$ when a circle is defined to have a diameter of D), and is a length of an inner wall face of the single oil passage constituted by the offset fins 3 and the tube 24 (length of a portion at which the inner wall and oil contact with each other).

Figure 13:
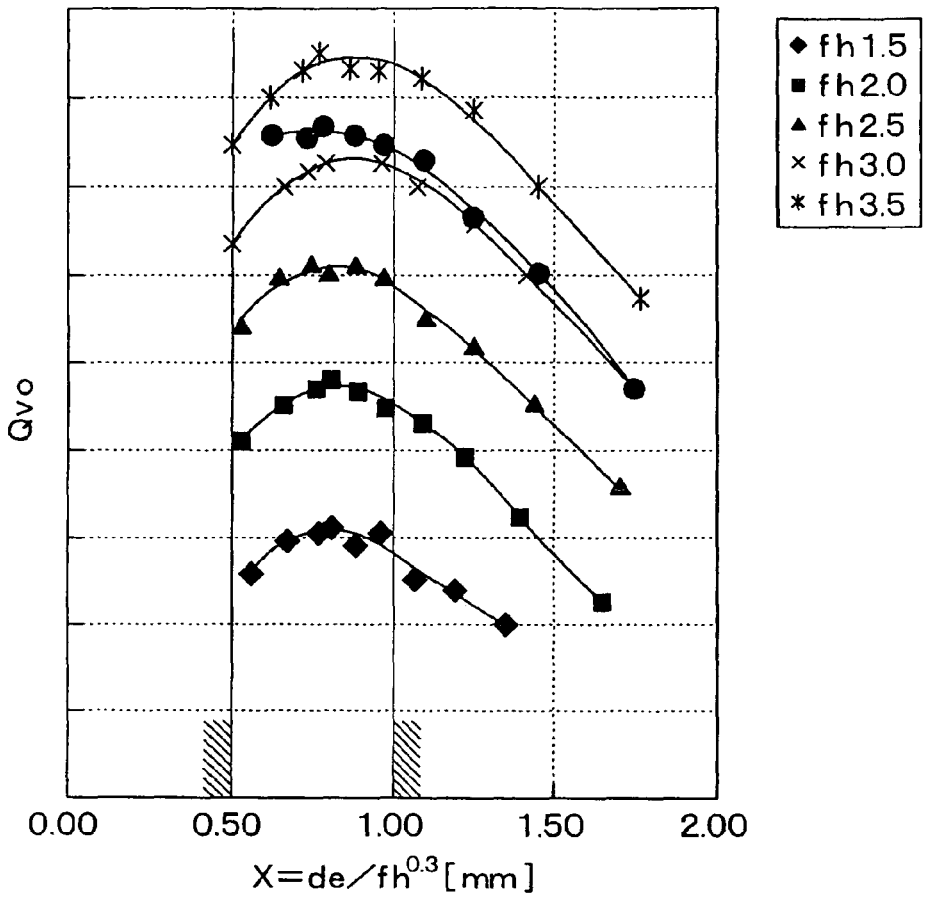
FIG. 13 is a characteristic view illustrating a relationship between a function X and the real-mounted performance Qvo.

FIG. 13 shows a relationship between the function X and the real-mounted performance Qvo. The function X is expressed by the following formula.

$$X=de/fh^{0.3}$$

In addition, in FIG. 13, only black dot plots represent plots under a condition where a segment length L to be mentioned later is set as 2.0 mm (fin height fh=3.0 mm). The other plots represent plots under a condition where the segment length L is set as 1.0 mm.

As shown in FIG. 13, even if a value of the fin height fh is arbitrarily set, the maximum values of the real-mounted performance Qvo become almost equal with each other, because of the function X. The real-mounted performance Qvo can be raised by making the corresponding circle diameter de and the fin height fh to have dimensions that satisfy a relationship of $0.5\leq X\leq 1.0$. Further, it is more desirable to make the corresponding circle diameter de and the fin height fh to have dimensions that satisfy a relationship of $0.6\leq X\leq 0.9$.

By the way, when the louver 32 of the offset fin 3 is defined to have the segment length L (unit: mm) in the oil flowing direction, as the segment length L is made longer, the number of positive tearing of the thermal boundary layer in the oil flowing direction is increased. Therefore, while heat transfer is promoted, the pressure loss is increased by collision to a front edge of the fin.

For this reason, in the embodiment, the segment length L is set to satisfy a relationship of $1.0\leq L\leq 3.0$. Thereby, the thermal boundary layer can be effectively cut in the oil flowing direction before the heat-transfer promoting effect is lost by full development of the thermal boundary layer in the oil flowing direction. Thus, the radiation performance can be restricted from becoming lowered, and the pressure loss can be greatly reduced. In addition, since the heat transfer area of the offset fin 3 is determined by the fin pitch fp and the fin height fh, the segment length L is not affected.

As explained above, the real-mounted performance Qvo, which is an index in consideration of both the radiation performance Qo and the pressure loss $\Delta Po$, can be raised by setting the fin pitch fp and the fin height fh of the offset fin 3 to satisfy the relationship of $0.3<fp/fh<0.8$. Further, within the range of $0.3<fp/fh<0.8$, the real-mounted performance ratio is secured to be equal to or higher than 115%, so that the stacking number of the tubes 24 can be reduced by at least one-stack relative to the conventional oil cooler.

That is, the radiation performance can be raised by setting the fin pitch fp and the fin height fh of the offset fin 3 to satisfy the relationship of $0.3<fp/fh<0.8$, so that the same performance can be achieved as the conventional oil cooler even if the stacking number of the tubes 24 is decreased. Further, when the offset fin 3 is formed into the approximately rectangular shape in a manner that the fin height fh is larger the fin pitch fp, the flow-velocity distribution of oil can be equalized in the tube 24. For this reason, heat transfer is efficiently performed between the offset fin 3 and oil, so that the radiation performance can be raised.

Therefore, the performance can be raised while the tube number in the oil cooler 2 is reduced. The oil cooler 2 can be made smaller by reducing the tube number, so that the radiator tank 12*b* including the oil cooler 2 can be made thinner.

Figure 14:
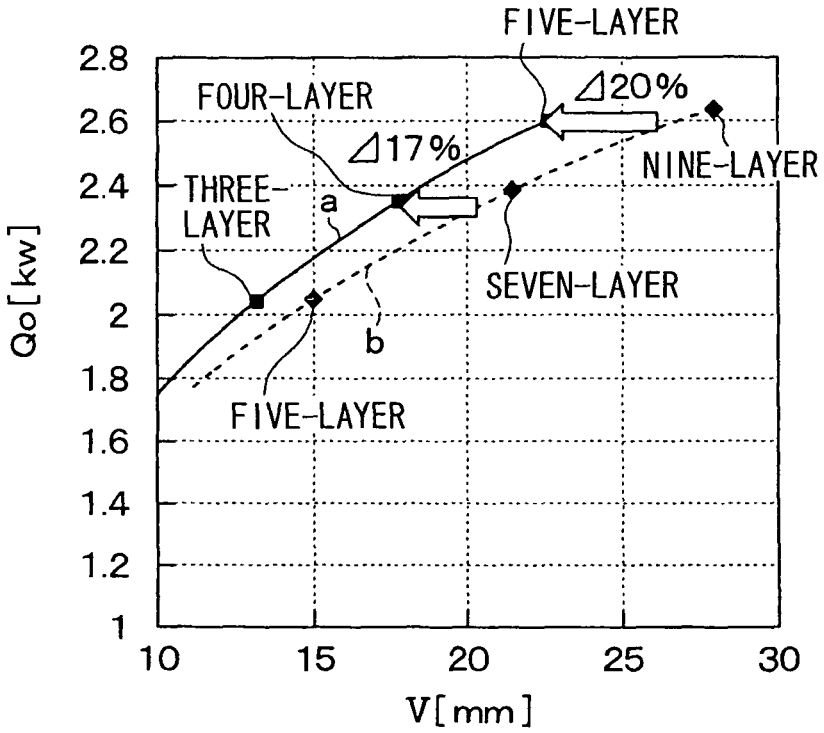
FIG. 14 is a characteristic view illustrating a relationship between a core volume V of the oil cooler and a heat emitting amount Qo.

FIG. 14 is a characteristic view showing a relationship between a volume of the core part 23 in the oil cooler 2 (hereinafter referred as core volume V) and a heat emitting amount Qo. In FIG. 14, a continuous-line a indicates the oil cooler 2 of the embodiment (fin pitch fp=1.7, fin height fh=3.0, aspect ratio fp/fh=≈0.57). A broken line b indicates the conventional oil cooler (fin pitch fp=3.0, fin height fh=1.5, aspect ratio fp/fh=2.0). Moreover, in FIG. 14, plots on the continuous line a show five-stack tubes 24, four-stack tubes 24, and three-stack tubes 24 from right in the drawing. Plots on the broken line b show nine-stack tubes, seven-stack tubes, and five-stack tubes from right in the drawing.

As shown in FIG. 14, the oil cooler 2 of the embodiment can achieve the same heat emitting amount as the conventional oil cooler, although the number of tubes is smaller in the oil cooler 2 of the embodiment than in the conventional oil cooler. Moreover, as the heat emitting amount Qo is increased, a lowering rate in the core volume V can be increased, using the oil cooler 2 of the embodiment. For this reason, it is especially effective to secure high radiation performance.

What is claimed is:

1. An oil cooler to cool oil by exchanging heat between oil and cooling medium, the oil cooler comprising: a plurality of tubes stacked with each other, oil passing inside of the tubes, cooling medium passing outside of the tubes; and a plurality of inner fins respectively arranged in the tubes, the inner fins promoting heat exchange between the oil and the cooling medium, wherein each of the inner fins is an offset fin having a wavy cross-section that is perpendicular to an oil flowing direction in which the oil flows, the wavy cross-section being defined by alternately placing first-side convex parts and second-side convex parts, the inner fin having a louver that is partially cut and bent in a direction parallel with the oil flowing direction, and a fin height fh is defined by a distance from a first-side convex part to a second-side convex part in a cross-section, an area surrounded by the inner fin, the tubes, and the first-side or second-side convex parts located adjacent each other on the same side in the cross-section being converted into a corresponding circle having a diameter de, a relationship of $X=de/fh^{0.3}$ being defined, the diameter of the corresponding circle and the fin height respectively have dimensions that satisfy a relationship of $0.5 \leq X \leq 1.0$; wherein the cooling medium is engine cooling water flowing between the tubes in a direction intersecting with a stacking direction of the tubes; a fin pitch fp is defined by a distance between center points of the first-side or the second-side convex parts located adjacent each other on the same side in a cross-section and the fin pitch and the fin height respectively have dimensions that satisfy a relationship of $0.3<fp/fh<0.8$; the tubes are arranged in a tank of a radiator; a width of a closed side of the first-side convex part is larger than a width of an opened side of the first-side convex part; each of the first-side convex parts and the second-side convex parts are joined to a flat surface of a respective tube; wherein each of the inner fins comprises multiple wavy parts, the multiple wavy parts comprising at least one first wavy part and at least one second wavy part, each first wavy part being directly adjacent to each second wavy part in the oil flowing direction, each first wavy part being offset from each second wavy part in a direction perpendicular to the oil flowing direction, the first and second wavy parts each having first-side convex parts and second-side convex parts, each first-side convex part includes a first wall extending at an angle of 0 degrees with respect to the direction of the fin height in cross-section, a second wall extending at an acute angle less than or equal to 20 degrees with respect to the direction of the fin height in cross-section, and an upper wall extending between the first wall and the second wall, each of the second-side convex parts includes said second wall of an adjacent first-side convex part, a third wall extending at an angle of 0 degrees with respect to the direction of the fin height in cross-section, and a lower wall extending between the second wall and the third wall; and the first wall of the first wavy part is closer to a first lateral end of the inner fin than the second wall of the first wavy part, the first wall of the second wavy part is closer to a second lateral end of the inner fin than the second wall of the second wavy part, the first and second lateral ends are spaced from one another in a direction perpendicular to the oil flow direction and perpendicular to the fin height direction, the first and second lateral ends are opposite from one another.

2. The oil cooler according to claim 1, wherein the diameter of the corresponding circle and the fin height respectively have dimensions that satisfy a relationship of $0.6 \leq X \leq 0.9$.

3. The oil cooler according to claim 1, wherein the fin pitch and the fin height respectively have dimensions that satisfy a relationship of $0.4<fp/fh<0.75$.

4. The oil cooler according to claim 1, wherein the fin pitch and the fin height respectively have dimensions that satisfy a relationship of $0.5<fp/fh<0.7$.

5. The oil cooler according to claim 1, wherein the louver of the inner fin has a segment length L in the oil flowing direction, and the segment length (unit: mm) has a dimension that satisfies $1.0 \leq L \leq 3.0$.

6. The oil cooler according to claim 1, wherein the oil cooler cools oil having a Prandtl number which is larger than 100.

7. The oil cooler according to claim 1, wherein an upper clearance of the second-side convex part that protrudes downward is smaller than a lower width of the second-side convex part.

8. The oil cooler according to claim 1, wherein both the upper wall and the lower wall are perpendicular to the direction of the fin height.

9. The oil cooler according to claim 1, wherein a length of the upper wall is greater than a distance between the first and second walls at a position adjacent the lower wall.

10. The oil cooler according to claim 9, wherein a length of the lower wall is greater than a distance between the second and third walls at a position adjacent the upper wall.

11. The oil cooler according to claim 1, wherein the first-side convex parts and the second-side convex parts are asymmetrical.

12. A cooling system comprising: a radiator having a first tank, a second tank and a plurality of tubes extending between the first and second tanks; wherein the engine cooling water flows through the first and second tanks and the plurality of tubes of the radiator; and an oil cooler to cool oil by exchanging heat between oil and cooling medium, the oil cooler comprising: a plurality of tubes stacked with each other, oil passing inside of the tubes, cooling medium passing outside of the tubes; and a plurality of inner fins respectively arranged in the tubes, the inner fins promoting heat exchange between the oil and the cooling medium, wherein each of the inner fins is an offset fin having a wavy cross-section that is perpendicular to an oil flowing direction in which the oil flows, the wavy cross-section being defined by alternately placing first-side convex parts and second-side convex parts, the inner fin having a louver that is partially cut and bent in a direction parallel with the oil flowing direction, and a fin height fh is defined by a distance from a first-side convex part to a second-side convex part in a cross-section, an area surrounded by the inner fin, the tubes, and the first-side or second-side convex parts located adjacent each other on the same side in the cross-section being converted into a corresponding circle having a diameter de, a relationship of $X=de/fh^{0.3}$ being defined, the diameter of the corresponding circle and the fin height respectively have dimensions that satisfy a relationship of $0.5 \leq X \leq 1.0$; wherein the cooling medium is engine cooling water flowing between the tubes in a direction intersecting with a stacking direction of the tubes; a fin pitch fp is defined by a distance between center points of the first-side or the second-side convex parts located adjacent each other on the same side in a cross-section and the fin pitch and the fin height respectively have dimensions that satisfy a relationship of $0.3<fp/fh<0.8$; the tubes are arranged in a tank of a radiator; a width of a closed side of the first-side convex part is lamer than a width of an opened side of the first-side convex part; each of the first-side convex parts and the second-side convex parts are joined to a flat surface of a respective tube; wherein each of the inner fins comprises multiple wavy parts, the multiple wavy parts comprising at least one first wavy part and at least one second wavy part, each first wavy part being directly adjacent to each second wavy part in the oil flowing direction, each first wavy part being offset from each second wavy part in a direction perpendicular to the oil flowing direction, the first and second wavy parts each having first-side convex parts and second-side convex parts, each first-side convex part includes a first wall extending at an angle of 0 degrees with respect to the direction of the fin height in cross-section, a second wall extending at an acute angle less than or equal to 20 degrees with respect to the direction of the fin height in cross-section, and an upper wall extending between the first wall and the second wall, each of the second-side convex parts includes said second wall of an adjacent first-side convex part, a third wall extending at an angle of 0 degrees with respect to the direction of the fin height in cross-section, and a lower wall extending between the second wall and the third wall; and the first wall of the first wavy part is closer to a first lateral end of the inner fin than the second wall of the first wavy part, the first wall of the second wavy part is closer to a second lateral end of the inner fin than the second wall of the second wavy part, the first and second lateral ends are spaced from one another in a direction perpendicular to the oil flow direction and perpendicular to the fin height direction, the first and second lateral ends are opposite from one another.

13. The cooling system according to claim 12, wherein an inlet and an outlet of the oil cooler extend through a side wall of the second tank.

14. The cooling system according to claim 12, wherein the first-side convex parts and the second-side convex parts are asymmetrical.

* * * * *